US012151339B2

(12) United States Patent
Saito

(10) Patent No.: US 12,151,339 B2
(45) Date of Patent: Nov. 26, 2024

(54) GRINDING WHEEL AND WAFER GRINDING METHOD

(71) Applicant: DISCO CORPORATION, Tokyo (JP)

(72) Inventor: Yoshinobu Saito, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 12 days.

(21) Appl. No.: 17/398,076

(22) Filed: Aug. 10, 2021

(65) Prior Publication Data

US 2022/0063059 A1 Mar. 3, 2022

(30) Foreign Application Priority Data

Aug. 25, 2020 (JP) ..... 2020-141563

(51) Int. Cl.
*B24D 7/06* (2006.01)
*B24B 7/22* (2006.01)

(52) U.S. Cl.
CPC ..... *B24D 7/066* (2013.01); *B24B 7/228* (2013.01)

(58) Field of Classification Search
CPC . B24D 7/06; B24D 7/066; B24D 7/16; B24D 7/186; B24D 7/18; B24D 2203/00; B24B 7/228
USPC ..... D15/126; D8/70
See application file for complete search history.

(56) References Cited

U.S. PATENT DOCUMENTS 3,745,719 A 7/1973 Oswald
6,196,911 B1 * 3/2001 Preston ..... B24D 7/06 451/529
8,951,099 B2 2/2015 Wu et al.
9,938,440 B2 * 4/2018 Bujnowski ..... B24D 3/02
10,086,499 B2 * 10/2018 Mejean ..... B24D 7/06
(Continued)

FOREIGN PATENT DOCUMENTS

CN 108115590 A 6/2018
DE 10139762 A1 2/2003
DE 102018214078 A1 2/2019
(Continued)

OTHER PUBLICATIONS

Machine translation of JP-2020093338-A to Kawana (Year: 2020).*
(Continued)

*Primary Examiner* — Joel D Crandall
*Assistant Examiner* — Jonathan R Zaworski
(74) *Attorney, Agent, or Firm* — Greer, Burns & Crain, Ltd.

(57) ABSTRACT

A grinding wheel includes an annular base having a free end portion and a plurality of segment grindstones fixed on the free end portion of the annular base in a state of being spaced from one another in a circumferential direction. The plurality of segment grindstones are divided into a plurality of grindstone groups each including a predetermined number of segment grindstones. Each of the segment grindstones included in each of the grindstone groups has a grinding surface formed into a rectangular shape having a long side and a short side. The segment grindstones of the grindstone group are sequentially fixed on the free end portion of the annular base from an outer circumferential side toward an inner circumferential side such that directions in which the long sides of the segment grindstones extend are changed from the circumferential direction to a diametric direction of the free end portion.

4 Claims, 7 Drawing Sheets

(56) References Cited

U.S. PATENT DOCUMENTS

| | | | | |
|---|---|---|---|---|
| 2003/0054746 | A1 | 3/2003 | Nussbaumer et al. | |
| 2019/0076990 | A1 * | 3/2019 | Pekija | B24B 7/228 |

FOREIGN PATENT DOCUMENTS

| | | | | | |
|---|---|---|---|---|---|
| JP | 2002233960 | A | | 8/2002 | |
| JP | 2008229820 | A | | 10/2008 | |
| JP | 2009246098 | A | | 10/2009 | |
| JP | 2017047520 | A | * | 3/2017 | B24B 37/042 |
| JP | 2020093338 | A | * | 6/2020 | |

OTHER PUBLICATIONS

Office Action issued in counterpart German patent application No. 10 2021 208 634.9, dated Mar. 23, 2022.
Search Report and Written Opinion issued in counterpart Singapore Patent Application No. 10202108474V, dated Nov. 18, 2022.

* cited by examiner

GRINDING WHEEL AND WAFER GRINDING METHOD

BACKGROUND OF THE INVENTION

Field of the Invention

The present invention relates to a grinding wheel that includes an annular base and a plurality of segment grindstones disposed on a free end portion of the annular base and that grinds a wafer, and a wafer grinding method of grinding the wafer by use of the grinding wheel.

Description of the Related Art

A wafer having a front surface formed with a plurality of devices such as integrated circuits (ICs) and large-scale integrated (LSI) circuits in regions partitioned by a plurality of intersecting division lines is ground on the back side by a grinding apparatus to a desired thickness and is then divided by a dicing apparatus into individual device chips. The device chips thus divided are used for electric equipment such as mobile phones and personal computers.

The grinding apparatus generally includes a chuck table that holds the wafer under suction, a grinding unit that grinds the wafer held by the chuck table, and a grinding water supply mechanism that supplies grinding water to a grinding wheel constituting the grinding unit, and can form the wafer to a desired thickness (see, for example, Japanese Patent Laid-open No. 2009-246098).

SUMMARY OF THE INVENTION

Incidentally, as illustrated in FIGS. 7A and 7B, a grinding wheel 104 generally known in the related art is mounted to a wheel mount 103 formed at a lower end of a rotary shaft 102, and has a structure in which a plurality of segment grindstones 106 are disposed in a concentric pattern on a free end portion (lower end surface) 105*a* of an annular base 105. The grinding wheel 104 is positioned such that the segment grindstones 106 of the grinding wheel 104 rotating in the direction indicated by an arrow R2 pass through a center O of a wafer 120 held through a protective tape 122 by a chuck table 110 rotating in the direction indicated by an arrow R1, thereby grinding the wafer 120 to a desired thickness.

However, in the existing configuration, all the segment grindstones 106 always pass through the center O of the wafer 120. Accordingly, as depicted in FIG. 7C, a central region 124 (a region of approximately 30 mm in diameter) of the wafer 120 having, for example, a diameter of 100 mm is ground more (on the order of 1 to 2 μm) than an outer circumferential region 126, so that the central region 124 tends to be processed to be thinner than the outer circumferential region 126. Particularly, in the case where the finish thickness of the wafer 120 is equal to or less than 50 μm, such thickness variability is not negligible. Note that FIG. 7B is a diagram in which the annular base 105 is viewed from the free end portion 105*a* side, that is, from a lower end surface side, and the position of the wafer 120 to be ground is also represented by alternate long and two short dashes line.

Accordingly, it is an object of the present invention to provide a grinding wheel and a wafer grinding method with which thickness variability can be reduced.

In accordance with an aspect of the present invention, there is provided a grinding wheel including an annular base having a free end portion and a plurality of segment grindstones fixed on the free end portion of the annular base in a state of being spaced from one another in a circumferential direction. The plurality of segment grindstones are divided into a plurality of grindstone groups each including a predetermined number of segment grindstones. Each of the segment grindstones included in each of the grindstone groups has a grinding surface formed into a rectangular shape having a long side and a short side. The segment grindstones of the grindstone group are sequentially fixed on the free end portion of the annular base from an outer circumferential side toward an inner circumferential side such that directions in which the long sides of the segment grindstones extend are changed from the circumferential direction to a diametric direction of the free end portion.

In accordance with another aspect of the present invention, there is provided a wafer grinding method using a grinding wheel that includes an annular base having a free end portion and a plurality of segment grindstones fixed on the free end portion of the annular base in a state of being spaced from one another in a circumferential direction. The plurality of segment grindstones are divided into a plurality of grindstone groups each including a predetermined number of segment grindstones. Each of the segment grindstones included in each of the grindstone groups has a grinding surface formed into a rectangular shape having a long side and a short side. The segment grindstones of the grindstone group are sequentially fixed on the free end portion of the annular base from an outer circumferential side toward an inner circumferential side such that directions in which the long sides of the segment grindstones extend are changed from the circumferential direction to a diametric direction of the free end portion. The wafer grinding method includes a holding step of holding a wafer by a rotatable chuck table while a center of the wafer is positioned at a rotational center of the chuck table; a positioning step of rotating the grinding wheel in a direction extending from the segment grindstone on the outer circumferential side whose long side is disposed along the circumferential direction, to the segment grindstone on the inner circumferential side whose long side is disposed along the diametric direction, the segment grindstone on the outer circumferential side and the segment grindstone on the inner circumferential side being included in the same grindstone group, and positioning the grinding wheel such that the segment grindstone on an outermost circumferential side passes through the center of the wafer; and a grinding step of bringing the segment grindstones of the rotating grinding wheel into contact with the wafer held by the rotating chuck table, to grind the wafer while grinding water is supplied from a central portion of the grinding wheel, after the positioning step is carried out.

According to the grinding wheel of the present invention, the segment grindstones that pass through the center of the wafer at the time of grinding are restricted, the tendency of the central region of the wafer being processed to be thinner than the outer circumferential region is restrained, and the problem that thickness variability is not negligible as the finish thickness of the wafer is equal to or less than 50 μm is solved.

According to the wafer grinding method of the present invention, the tendency of the central region of the wafer being processed to be thinner than the outer circumferential region is restrained, and the problem that thickness variability is not negligible as the finish thickness of the wafer is equal to or less than 50 μm is solved. In addition, since the grindstone groups are arranged in an impeller form, when grinding water is supplied from a central portion of the grinding wheel, the grindstone groups function as centrifugal pumps, so that the grinding water can efficiently be discharged toward the outside. Therefore, grinding efficiency can be enhanced.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

According to an embodiment of the present invention, a grinding wheel and a wafer grinding method carried out by using the grinding wheel will be described in detail below referring to the attached drawings.

Figure 1:
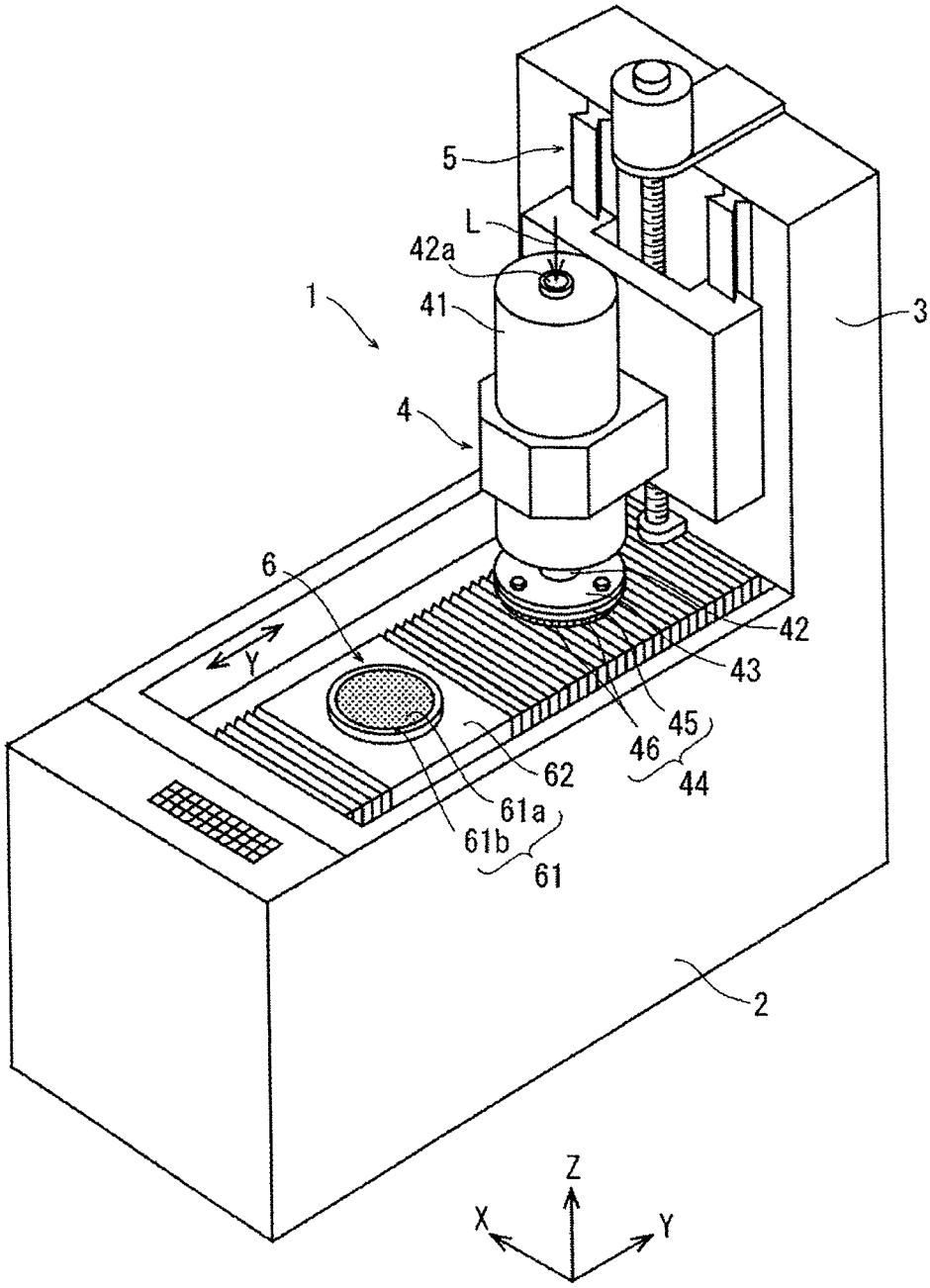
FIG. 1 is a general perspective view of a grinding apparatus according to an embodiment of the present invention.

FIG. 1 depicts a general perspective view of a grinding apparatus 1 adopting the grinding wheel of the present embodiment. The grinding apparatus 1 includes an apparatus housing 2, a wall section 3 erected on the apparatus housing 2, a grinding unit 4 that grinds a workpiece, a lift mechanism 5 that is disposed on a front side of the wall section 3 and lifts the grinding unit 4 upward and downward, and a table unit 6 having a chuck table 61 that holds the workpiece.

The grinding unit 4 includes a rotary shaft 42 rotationally driven by an electric motor 41, a wheel mount 43 disposed at a lower end of the rotary shaft 42, and a grinding wheel 44 mounted on a lower surface of the wheel mount 43. Grinding water L supplied from a grinding water supply mechanism (not illustrated) is introduced from an upper end portion 42*a* of the rotary shaft 42 and is supplied to a central part on the free end portion side of the grinding wheel 44 through the rotary shaft 42.

The table unit 6 includes the chuck table 61 and a cover plate 62. The chuck table 61 includes a disk-shaped suction chuck 61*a* and a frame body 61*b* surrounding the suction chuck 61*a*, as illustrated in FIG. 1, and is configured to be rotatable by a rotational drive source (not illustrated). The cover plate 62 causes the chuck table 61 to protrude upward and covers the surrounding of the chuck table 61. The table unit 6 includes a conveying-in/out region (the region where the chuck table 61 is located in FIG. 1) which is held by a moving base (not illustrated) accommodated in the apparatus housing 2 and at which the workpiece is conveyed in and out by moving the chuck table 61 in the direction indicated by an arrow Y. The table unit 6 also includes moving means (not illustrated) that positions the table unit 6 in a grinding region on the lower side of the grinding unit 4.

Figure 2A:
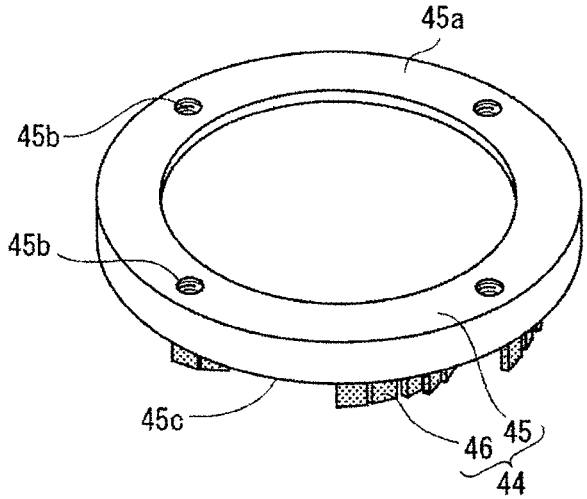
FIG. 2A is a perspective view of a grinding wheel of the present embodiment.
Figure 2B:
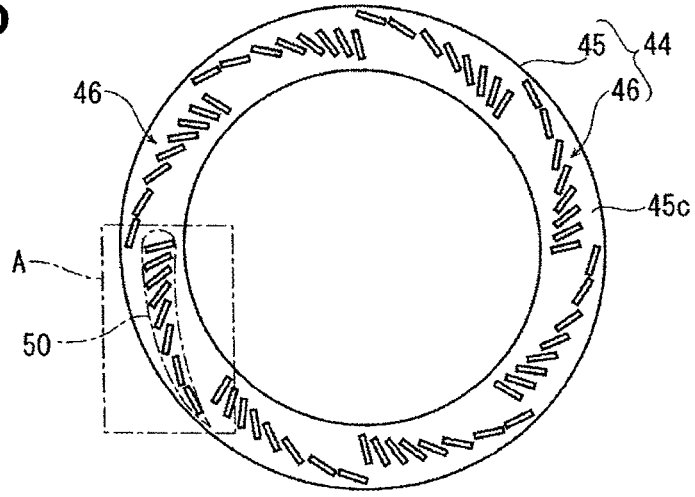
FIG. 2B is a plan view, as viewed from a lower side, of the grinding wheel depicted in FIG. 2A.
Figure 2C:
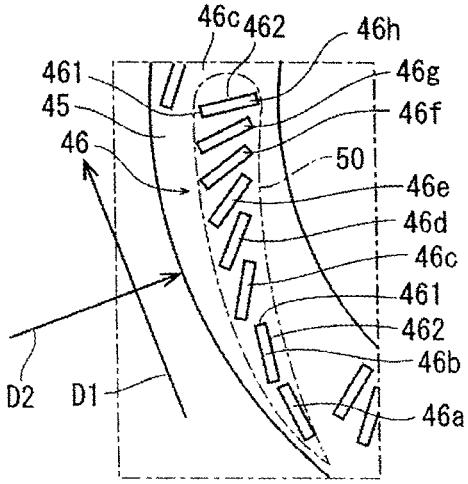
FIG. 2C is an enlarged view of a region A depicted in FIG. 2B.

FIGS. 2A to 2C illustrate the grinding wheel 44 of the present embodiment that is detached from the wheel mount 43 of the abovementioned grinding unit 4. As depicted in FIG. 2A, the grinding wheel 44 includes an annular base 45 and a plurality of segment grindstones 46. An upper surface 45*a* of the annular base 45 is formed with screw holes 45*b* to be used when the annular base 45 is mounted to the wheel mount 43, and the plurality of segment grindstones 46 are disposed at a free end portion 45*c* which is a lower end surface of the annular base 45. FIG. 2B depicts a plan view of the annular base 45 as viewed from the free end portion 45*c* side, and FIG. 2C depicts an enlarged view of a region A depicted in FIG. 2B.

As depicted in FIGS. 2B and 2C, in the present embodiment, eight segment grindstones 46*a* to 46*h* are sequentially disposed in an impeller form in the circumferential direction (indicated by an arrow D1) of the free end portion 45*c* to form a grindstone group 50, and a plurality of grindstone groups 50 similar to the abovementioned grindstone group 50 are disposed along the circumferential direction of the free end portion 45*c* of the annular base 45.

As depicted in FIG. 2C, each of the segment grindstones 46*a* to 46*h* has a grinding surface formed into a rectangular shape having a short side 461 and a long side 462. The segment grindstones 46*a* to 46*h* are disposed such that their positions are varied from the outer circumference to the inner circumference of the free end portion 45*c* of the annular base 45, towards the direction in which the grinding wheel 44 is rotated at the time of grinding (the same direction as the direction indicated by the circumferential direction D1 illustrated in FIG. 2C). Also, the segment grindstones 46*a* to 46*h* are sequentially disposed such that the direction in which the long side 462 of each segment grindstone extends is gradually changed from the direction along the circumferential direction D1 to a diametric direction D2 orthogonal to the circumferential direction D1. As a result, when the grindstone group 50 including the segment grindstones 46*a* to 46*h* is treated as one unit, it has the shape of what is called an impeller, as indicated by alternate long and short dash line.

The grinding apparatus 1 of the present embodiment generally has the configuration described above. The operation and effect of the abovementioned grinding wheel 44 and the wafer grinding method using the grinding wheel 44 will be described below.

Figure 3:
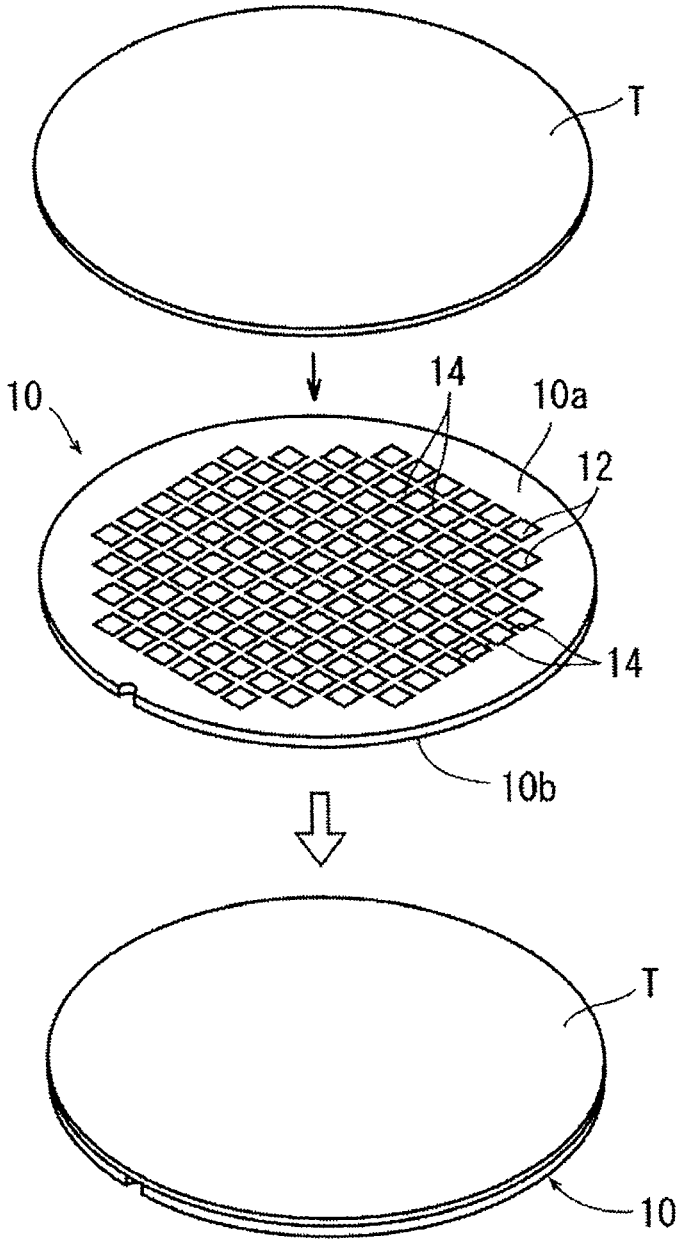
FIG. 3 is a perspective view depicting a wafer as a workpiece, a protective tape, and an attaching manner.

First, when carrying out the wafer grinding method of the present embodiment, a wafer 10 as a workpiece is prepared as depicted in FIG. 3. The wafer 10 is, for example, a silicon wafer having a diameter of 100 mm, with a plurality of devices 12 formed on a front surface 10*a* in regions partitioned by division lines 14. When such a wafer 10 is prepared, a protective tape T is integrally attached to the front surface 10*a*, as illustrated in FIG. 3.

Figure 4:
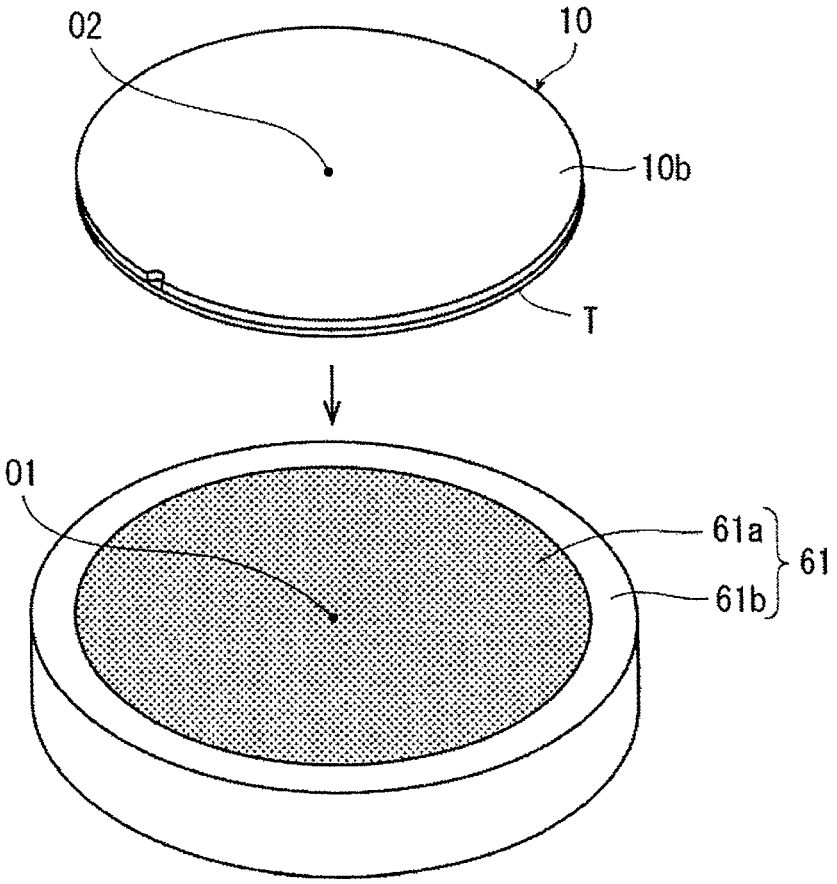
FIG. 4 is a perspective view depicting an example of a holding step of the present embodiment.

When the wafer 10 is prepared as above, the prepared wafer 10 is conveyed to the grinding apparatus 1 described in FIG. 1, and as depicted in FIG. 4, the wafer 10 is mounted and held on the chuck table 61 with a center O2 of the wafer 10 positioned at a rotational center O1 of the chuck table 61, in a state in which a back surface 10*b* of the wafer 10 is directed upward and the protective tape T is directed downward (holding step).

Figure 5:
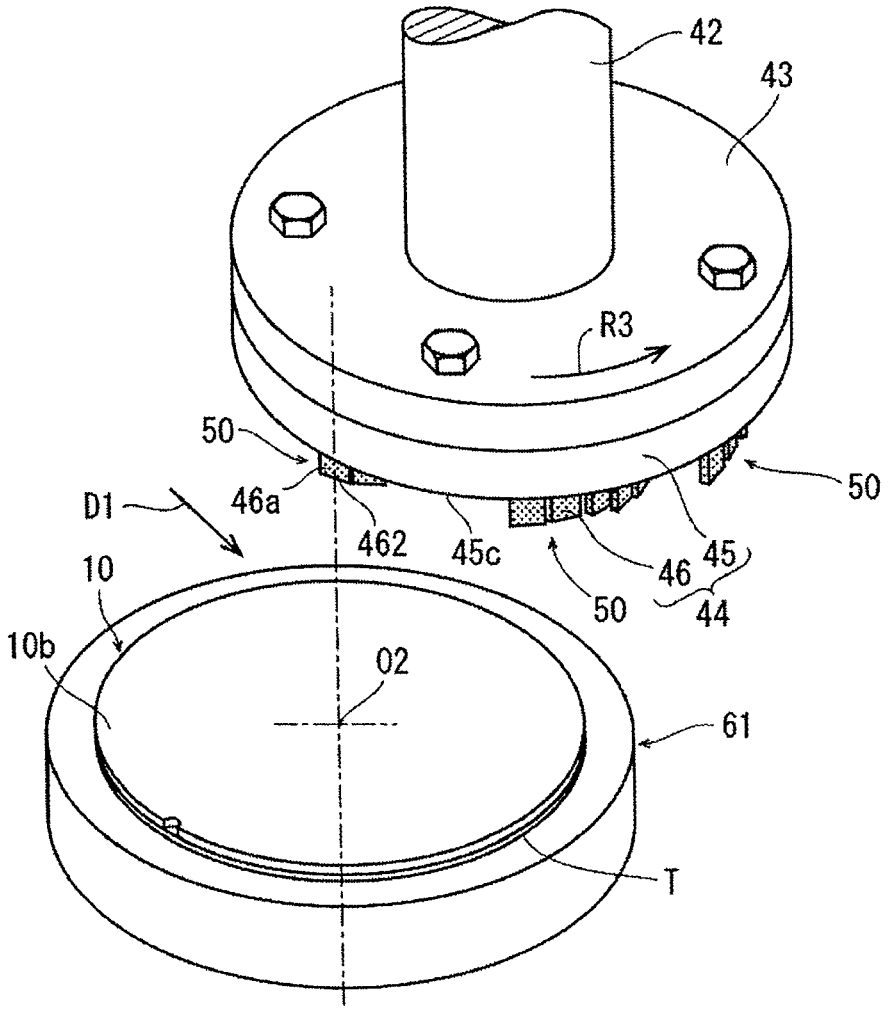
FIG. 5 is a perspective view depicting an example of a positioning step of the present embodiment.

Next, as illustrated in FIG. 5, the grinding wheel 44 is rotated in a direction extending from the side of the segment grindstone 46*a* having the long sides 462 disposed along the circumferential direction D1 to the side of the segment grindstone 46*h* (also see FIG. 2C) having the long sides 462 disposed along the diametric direction D2, that is, in the direction indicated by an arrow R3 in FIG. 5. At the same time, the moving means (not illustrated) is operated to move the chuck table 61, thereby positioning the grinding wheel 44 such that the segment grindstone 46*a* disposed on the outer circumference side passes through the center O2 of the wafer 10 (positioning step).

Figure 6A:
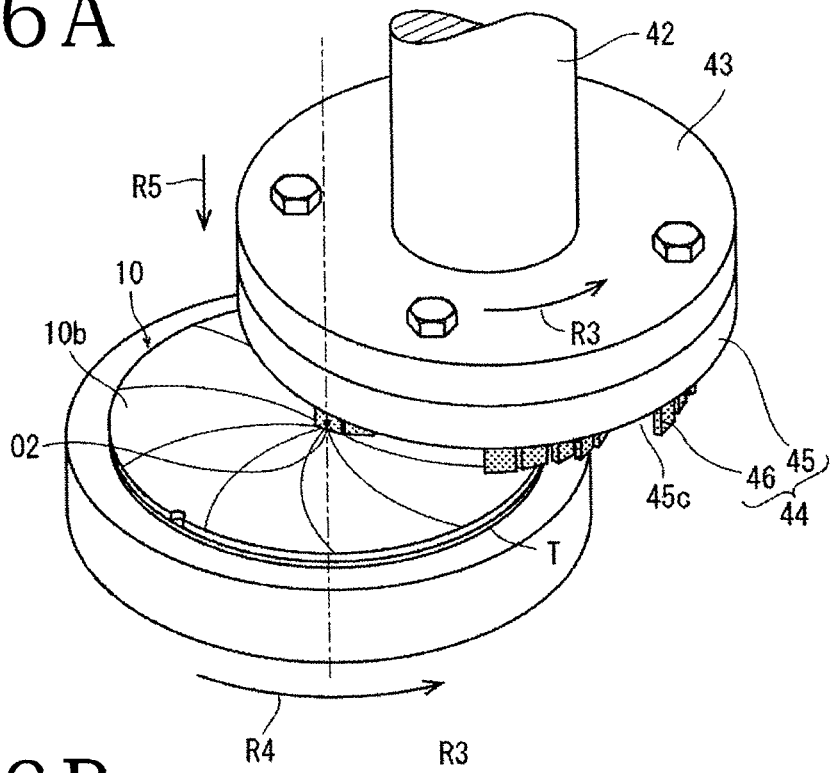
FIG. 6A is a perspective view depicting an example of a grinding step of the present embodiment.
Figure 6B:
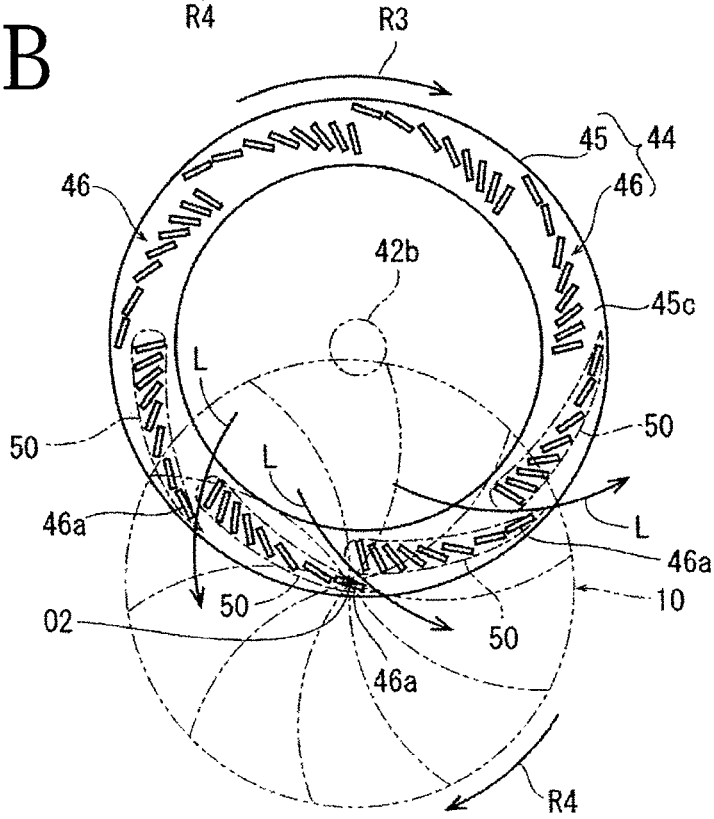
FIG. 6B is a plan view, as viewed from a lower side, of the grinding wheel in the grinding step.
Figure 7A:
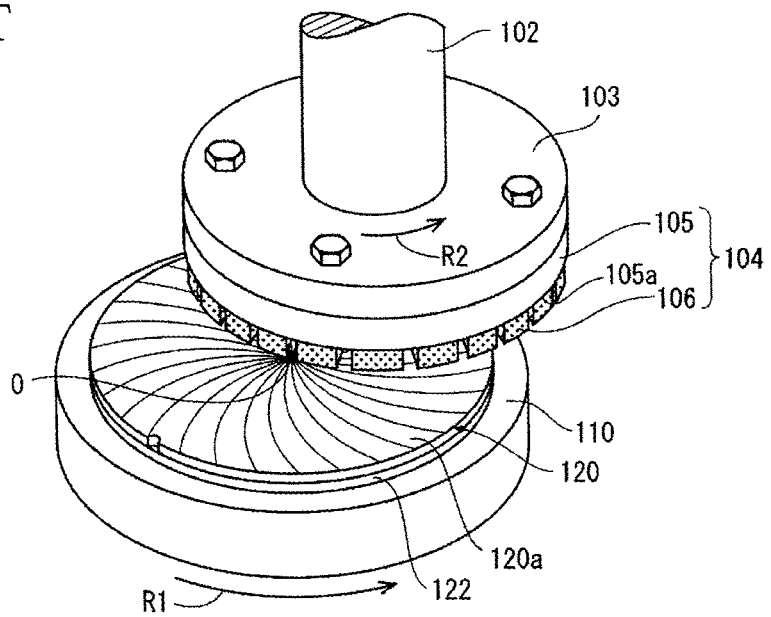
FIG.7A PRIOR ART
FIG. 7A is a perspective view depicting an example of a grinding step carried out by a grinding wheel according to the related art.
Figure 7B:
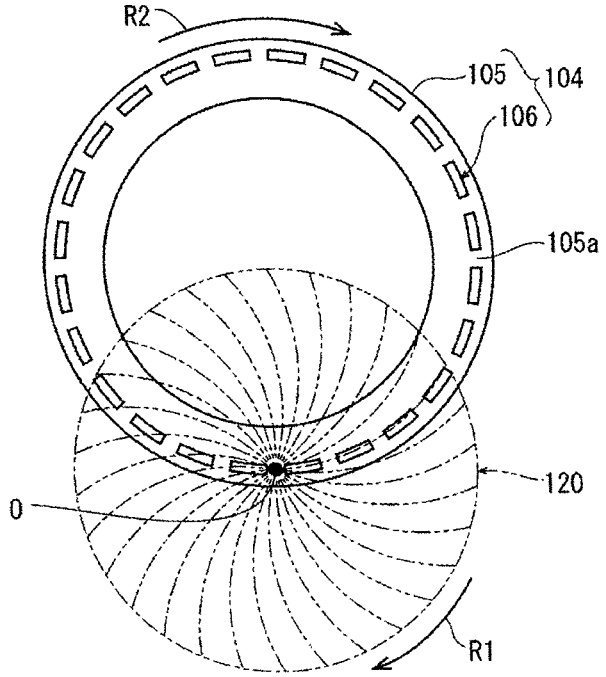
FIG.7B PRIOR ART
FIG. 7B is a plan view, as viewed from a lower side, of the grinding wheel in the grinding step according to the related art.
Figure 7C:
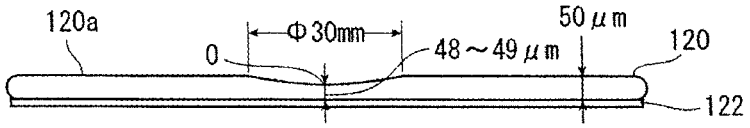
FIG.7C PRIOR ART
FIG. 7C is a sectional view of a wafer to which the grinding step according to the related art has been applied.

Subsequently, as depicted in FIG. 6A, the chuck table 61 is rotated in the direction indicated by R4. At the same time, the lift mechanism 5 described in FIG. 1 is operated to lower the grinding unit 4 in the direction indicated by an arrow R5, thereby bringing the grindstone groups 50 of the grinding wheel 44 into contact with the back surface 10*b* of the wafer 10. Then, while the thickness of the wafer 10 is measured by thickness detection means (not illustrated), the wafer 10 is ground to a desired thickness (for example, 50 μm). In this instance, as depicted in FIG. 6B, a grinding water supply hole 42*b* as a lower end of the rotary shaft 42 is located at a central portion of the free end portion 45*c* of the grinding wheel 44, and grinding water L is supplied from the grinding water supply hole 42*b*. The grinding water L is introduced to a grinding part where the grindstone groups 50 including the segment grindstones 46 are bought into contact with the back surface 10*b* of the wafer 10, by a centrifugal force (grinding step).

In the abovementioned grinding step, as understood from FIG. 6B, with regard to the segment grindstones 46*a* to 46*h* included in the grindstone groups 50 disposed on the annular base 45 of the grinding wheel 44, only the segment grindstones 46*a* disposed on the outermost circumferential side pass through the center O2 of the wafer 10, and the movements of the segment grindstones 46*b* to 46*h* disposed other positions (on the inner circumferential side of the annular base 45) are restricted so as not to pass through the center O2 of the wafer 10. As a result, the central region of the back surface 10*b* of the wafer 10 is restrained from being processed to be thinner than the outer circumferential region, and the problem that the thickness variability is not negligible as the finish thickness of the wafer 10 becomes equal to or less than 50 μm is solved.

Note that the present invention is not limited to the case where only the segment grindstones 46*a* disposed on the outermost circumferential side among the segment grindstones 46*a* to 46*h* passes through the center O2 of the wafer 10 as described above, and in addition to the segment grindstones 46*a*, the segment grindstones 46*b* disposed at adjacent positions may also pass through the center O2 of the wafer 10. In the present invention, it is important not to allow all of the segment grindstones 46*a* to 46*h* forming the grindstone groups 50 to pass through the center O2 of the wafer 10, but allow only some of the segment grindstones to pass through the center O2 of the wafer 10.

Further, as described above, the grindstone group 50 of the present embodiment includes the plurality of segment grindstones 46*a* to 46*h* and has an impeller form as a whole, and a plurality of grindstone groups 50 are disposed in the circumferential direction. With such a configuration, as depicted in FIG. 6B, the grinding water L supplied from a central portion of the grinding wheel 44 of the grinding unit 4 is introduced to the grinding part on the outer circumferential side by a centrifugal force, and the plurality of grindstone groups 50 in the impeller form functions as centrifugal pumps, so that the grinding water L is efficiently discharged from the inside to the outside of the grinding wheel 44. Therefore, grinding efficiency can be enhanced.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding wheel comprising:

an annular base having a free end portion; and a plurality of segment grindstones fixed on the free end portion of the annular base in a state of being spaced from one another in a circumferential direction extending along a circumference of the annular base, wherein the plurality of segment grindstones are divided into a plurality of grindstone groups each including a predetermined number of segment grindstones, and wherein adjacent grindstone groups at least partially overlap each other in a diametric direction extending along the circumference of the annular base, the diametric direction extending from an outer circumferential side toward an inner circumferential side of the annular base and substantially transverse to a longitudinal axis of each of the grindstone groups, each of the segment grindstones included in each of the grindstone groups has a grinding surface formed into a rectangular shape having a long side and a short side, and wherein the segment grindstones of each of the grindstone groups are sequentially fixed on the annular base from the outer circumferential side toward the inner circumferential side such that a direction in which the long side of each of the segment grindstones extends changes from the circumferential direction to the diametric direction, wherein a first segment grindstone at a first end of each of the grindstone groups extends substantially in the circumferential direction and a second segment grindstone at an opposing second end of each of the grindstone groups extends substantially in the diametric direction such that a width of a grinding area of each of the grindstone groups is greater at the second end than a width of the grinding area at the first end, wherein the width of the grinding area of each of the grindstone groups gradually increases from the first end to the second end, and wherein an adjacent segment grindstone that is adjacent to said first segment grindstone at said first end of each of the grindstone groups has a longitudinal axis that extends through all of the subsequent segment grindstones between the adjacent segment grindstone and said second end of each of the grindstone groups.

2. The grinding wheel according to claim 1, wherein grindstone segments in each of the grindstone groups are identical.

3. A wafer grinding method using a grinding wheel that includes an annular base having a free end portion and a plurality of segment grindstones fixed on the free end portion of the annular base in a state of being spaced from one another in a circumferential direction extending along a circumference of the annular base, the plurality of segment grindstones being divided into a plurality of grindstone groups each including a predetermined number of segment grindstones, each of the segment grindstones included in each of the grindstone groups having a grinding surface formed into a rectangular shape having a long side and a short side, wherein adjacent grindstone groups at least partially overlap each other in a diametric direction along a circumference of the annular base, the diametric direction extending from an outer circumferential side toward an inner circumferential side of the annular base and substantially transverse to a longitudinal axis of each of the grindstone groups, wherein the segment grindstones of the grindstone groups being sequentially fixed on the annular base from the outer circumferential side toward the inner circumferential side such that a direction in which the long side of the segment grindstones extends change from the circumferential direction to the diametric direction, wherein a first segment grindstone at a first end of each of the grindstone groups extends substantially in the circumferential direction and a second segment grindstone at an opposing second end of each of the grindstone groups extends substantially in the diametric direction such that a width of a grinding area of each of the grindstone groups is greater at the second end than a width of the grinding area at the first end, and wherein the width of the grinding area of each of the grindstone groups gradually increases from the first end to the second end and wherein an adjacent segment grindstone that is adjacent to said first segment grindstone at said first end of each of the grindstone groups has a longitudinal axis that extends through all of the subsequent segment grindstones between the adjacent segment grindstone and said second end of each of the grindstone groups, the wafer grinding method comprising:

a holding step of holding a wafer by a rotatable chuck table while a center of the wafer is positioned at a rotational center of the chuck table;

a positioning step of rotating the grinding wheel in a direction extending from the segment grindstones on the outer circumferential side whose long side is disposed along the circumferential direction, to the segment grindstones on the inner circumferential side whose long side is disposed along the diametric direction, the segment grindstones on the outer circumferential side and the segment grindstones on the inner circumferential side being included in a same grindstone group, and positioning the grinding wheel such that the segment grindstones on an outermost circumferential side passes through the center of the wafer; and a grinding step of bringing the segment grindstones of the rotating grinding wheel into contact with the wafer held by the rotating chuck table, to grind the wafer while grinding water is supplied from a central portion of the grinding wheel, after the positioning step is carried out.

4. The wafer grinding method according to claim 3, wherein grindstone segments in each of the grindstone groups are identical.

* * * * *